United States Patent [19]

Klausen et al.

[11] 4,421,117

[45] Dec. 20, 1983

[54] MATERNITY GARMENTS

[75] Inventors: Jack H. Klausen; Glori J. Klausen, both of Westlake Village, Calif.

[73] Assignee: Glori-Us Sportswear, Inc., Newbury Park, Calif.

[21] Appl. No.: 480,782

[22] Filed: Mar. 31, 1983

[51] Int. Cl.[3] ..... A41C 1/00

[52] U.S. Cl. ..... 128/555

[58] Field of Search ..... 128/555, 556, 554, 518, 128/542, 431, 579

[56] References Cited

U.S. PATENT DOCUMENTS

| | | | |
|---|---|---|---|
| 2,199,442 | 5/1940 | Mayonnade . | |
| 2,719,974 | 10/1955 | Blant | 128/555 |
| 3,080,869 | 3/1963 | Alberts | 128/542 |
| 3,273,563 | 9/1966 | Bonang | 128/579 |
| 3,357,435 | 12/1967 | Enrico | 128/431 |
| 3,890,979 | 6/1975 | Fierst | 128/555 |

*Primary Examiner*—Doris L. Troutman

*Attorney, Agent, or Firm*—Christie, Parker & Hale

[57] ABSTRACT

An undergarment and a leotard-style exercise garment which provide improved support for the enlarging abdomen during pregnancy. A relatively inelastic and vertically elongated back yoke panel is centered over the wearer's backbone, and serves as an anchor for lower trunk panels which are highly elastic in a generally horizontal direction, and much less elastic, and hence supportive, in a generally vertical direction. The trunk panels are expandable to accommodate the enlarging abdomen, while providing strong upward support for the abdomen and crotch area.

13 Claims, 7 Drawing Figures

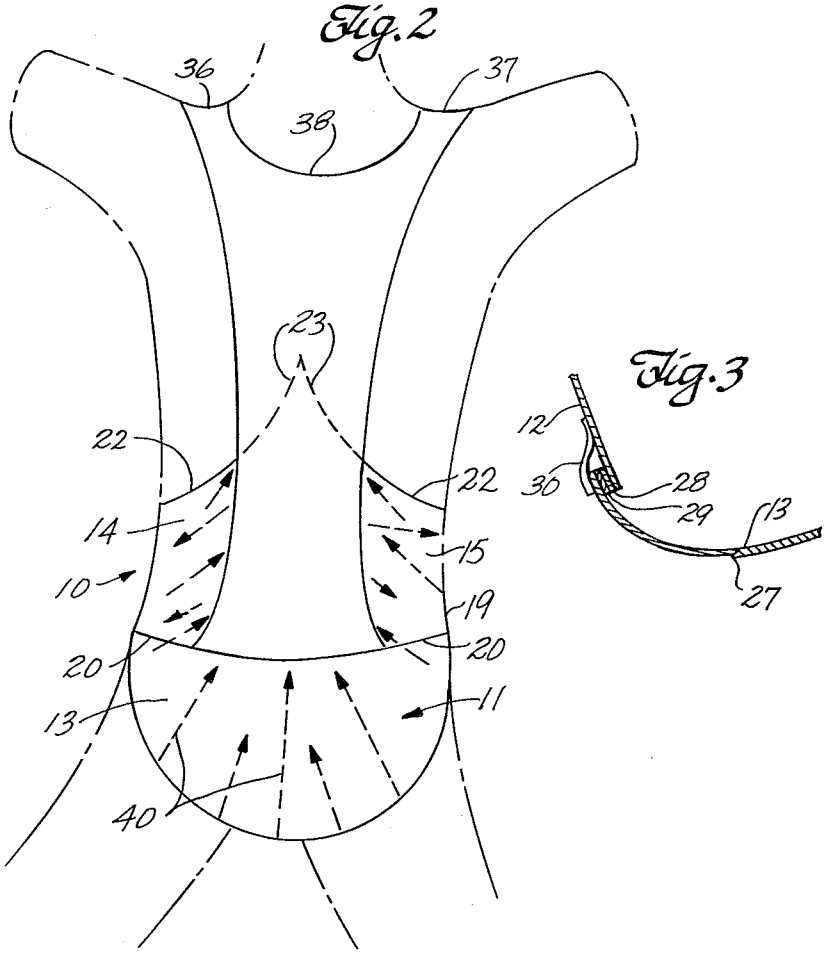
Fig. 2
37
36
36
23
22
22
15
19
20
11
14
10
20
13
40
Fig. 3
12
30
28
29
13
27
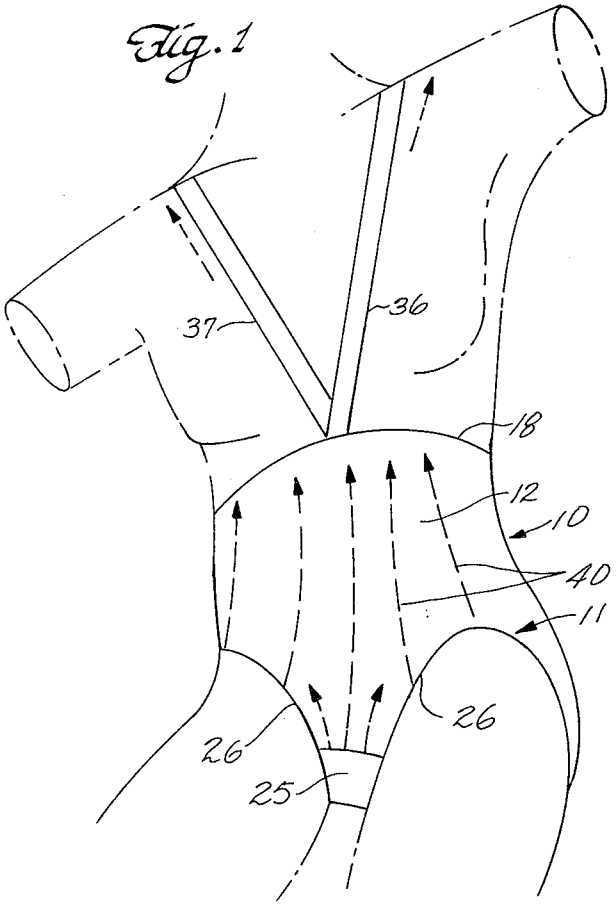
Fig. 1
37
36
18
12
10
40
11
26
26
25

67
71
68
72
63
55
51
64
58
60
59
70
54
57
53
50

67
72
63
66
52
51
68
71
65
75
73
74
56
57

MATERNITY GARMENTS

BACKGROUND OF THE INVENTION

The joyous aspects of pregnancy are commonly marred by physical discomforts suffered by the mother-to-be and her enlarging figure. Common complaints during pregnancy relate to lower back pain and pelvic aches, strain of the anterior abdominal muscle wall, sagging uterus and bladder pressure, pelvic and vulvar varicosities, and breast pain. The discomforts are real, and become especially disabilitating and tiring in the later stages of pregnancy.

Maternity girdles and brassieres of conventional styles offer some relief, but are piecemeal approaches which do not enable overall alleviation of the aforementioned discomforts of pregnancy. Maternity girdles, for example, rely for utero-abdominal support on an elastic waistband which powerfully constricts the midsection of the body, with resulting discomfort and interference with blood circulation. More importantly, these conventional maternity garments, whether of a girdle or full-body style, fail to transfer and distribute the tension load of abdominal support to other parts of the body in a way which is comfortable and effective in producing improved posture and distress relief.

The improved maternity garments of this invention overcome these problems by transferring the force of abdominal support to the physically strong skeleton and musculature of the upper body. The garments provide good freedom of movement, while at the same time urging the upper body and spine into a posturally correct position which mitigates or prevents back pain. The enlarging uterus is urged rearwardly and upwardly into a physiologically correct position which minimizes discomfort arising from uterus pressure against the anterior pelvis and bladder.

The improved garments are herein disclosed in terms of both an undergarment for use beneath conventional outerwear, and as an outergarment such as a leotard worn during exercise programs and similar activities. Both styles of garments incorporate a novel construction which provides the improved support, stress relief, and comfort already described.

SUMMARY OF THE INVENTION

Briefly stated, this invention relates to a maternity garment having a pantie which is elastically expandable in a generally horizontal axis, and much less elastic and accordingly supportive along a generally vertical axis. A wide yoke panel extends from the wearer's lower neck along the backbone to be joined to the rear of the pantie at about the waistline. A tensioning and attachment means extends over the shoulders, and is joined to the upper end of the yoke panel and upper front of the pantie to provide upward and rearward utero-abdominal support. The support forces are transferred to the shoulders and midback to correct back posture and to distribute these loads in a comfortable and effective way.

In the form of an undergarment, the attachment means may be a pair of straps extending over the shoulders. The garment can also be fashioned as a leotard with fabric portions enclosing the shoulders and upper body to provide the attachment means. Preferably, the pantie includes a pair of midback panels secured to the pantie front and to opposite side edges of the yoke panel. The midback panels have upwardly and rearwardly extending upper edges, the extended axes of which intersect in the mid-scapula region of the back.

BRIEF DESCRIPTION OF THE DRAWINGS

FIG. 1 is a front view of an undergarment according to the invention;

FIG. 2 is a rear view of the undergarment;

FIG. 3 is a sectional view of an alternative separable fastener on a crotch pawl, the fabric thickness being exaggerated for clarity;

DESCRIPTION OF THE PREFERRED EMBODIMENTS

Figure 4:
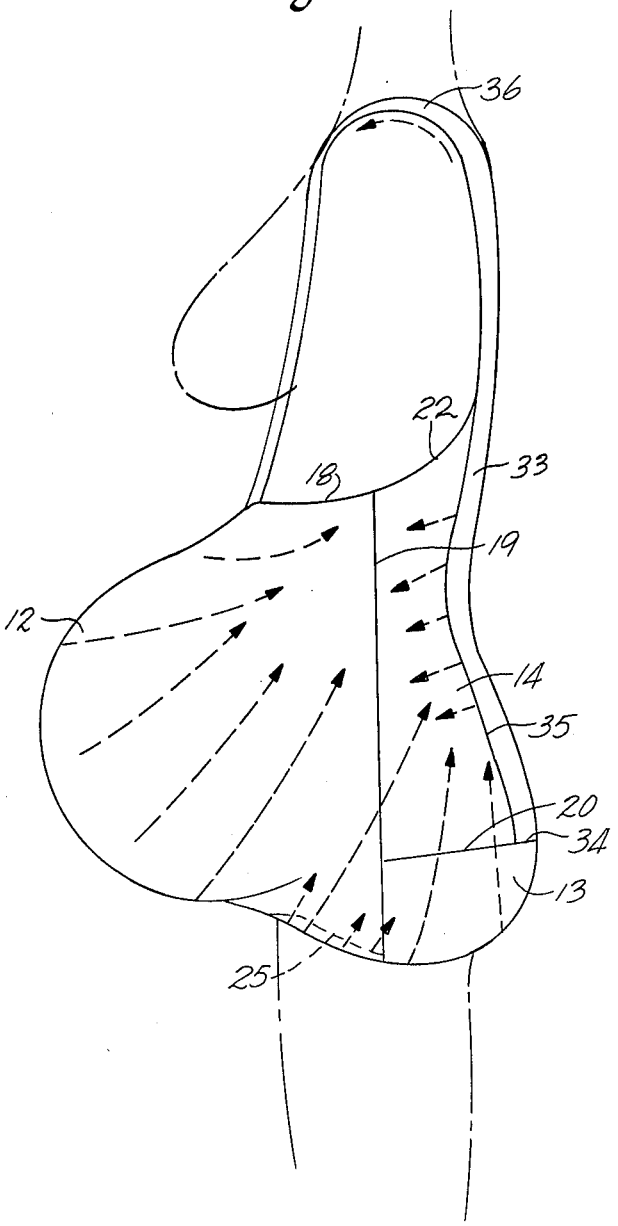
FIG. 4 is a side view of the undergarment as enlarged during a late stage of pregnancy.

A maternity undergarment 10 according to the insertion as shown in FIGS. 1–4, and includes a pantie 11 fitting over the lower trunk of a wearer. The pantie has a front panel 12, a rear or seat panel 13, and a pair of midback panels 14 and 15. Panels 12–15 are preferably made of the same material (further described below) and could be portions of an integrally formed pantie. For manufacturing convenience, however, these portions are formed as separate panels which are sewn together.

As shown in FIGS. 1, 2 and 4, front panel 12 terminates at an upper edge 18 which is preferably at or slightly above the waistline of the wearer. The front panel extends laterally around the hips and waist to be joined to forwardly extending edges of the seat and midback panels at side seams 19. The lower ends of the midback panels, which extend to or preferably below the waistline, are joined to the top of the seat panel by seams 20.

The rear side edges of the midback panels are not directly joined, and are spaced apart as shown in FIG. 2. Upper edges 22 of the midback panels extend both rearwardly and upwardly from side seams 19. The curvature of upper edges 22 is such that upper-edge contours would intersect in the mid-scapular region or the central upper back of the wearer if the contours were extended as suggested by phantom lines 23 in FIG. 2.

Pantie 11 is completed by a crotch panel 25 (FIGS. 1 and 3) which is secured to the lower central edges of the front and seat panels to define the usual leg openings 26. The rear end of the crotch panel is secured to the seat panel by a seam 27, and the front end of the crotch panel is preferably connected to the front panel by a detachable fastener. The fastener is conveniently made of facing pads 28 and 29 of hook and pile material as sold under the trademark Velcro, the pads being stitched to the adjacent overlapped ends of the front and crotch panels respectively. In a preferred form as shown in FIG. 3, the fastener is overlapped by a flap 30 sewn to the front panel and serving to cover the hook material of pad 28 to prevent the hook material of the unsecured fastener from engaging or catching on another part of the wearer's clothing. Button or snap fasteners may also be used, but the "Velcro" fastener is preferred as it uniformly distributes the tension load across the width of the joined panels.

An important feature of undergarment 10 is the use of a yoke panel 33 (FIG. 2) made of a relatively wide and inelastic fabric which extends from the wearer's lower neck to be secured to the upper edge of the seat panel at or below the waistline by a seam 34, and to the spaced-apart rear side edges of midback panels by seams 35. The yoke panel extends along and laterally from the backbone or midline of the wearer's back, and is preferably at least three or four inches in width for distribution of tension loads over a large area of the back. The lower part of the yoke panel is preferably outwardly flared in width as shown in FIG. 2 to provide upward tensioning along a significant length of the upper edge of seat panel 13.

The undergarment is completed by an attachment means which extends over the shoulders to connect the upper part of the yoke panel to the top of front panel 12. The purpose of the attachment means is to anchor and upwardly tension the front panel, to tension the seat and midback panels through the yoke, and to distribute the resulting mechanical forces over the shoulders and upper back.

The attachment means is made of a fabric which is relatively inelastic in the tensioned direction, and in the undergarment of FIGS. 1–4, is conveniently formed as a pair of straps 36 and 37 which are integral extensions of the fabric forming yoke panel 33. As shown in FIG. 2, the straps extend from an upper end 38 of the yoke panel to pass over the shoulders on opposite sides of the neck. The straps extend downwardly and toward each other across the front of the body for stitched attachment to upper edge 18 of the front panel. Alternatively, the straps may be secured to the front panel by releasable fasteners (buttons, snaps, "Velcro" pads, etc.), but stitched attachment is preferred to spread the load attachment surface of the straps and front panel.

Undergarment 10 is fashioned from commercially available fabrics, but a proper choice of fabric elasticity and orientation is important to achievement of the desired support properties. Pantie 11, with the exception of crotch panel 25, is made of an elastic undergarment fabric having markedly different elasticity in mutually perpendicular directions. The highly elastic axis is oriented generally horizontally to permit significant elongation around the buttocks, hips, and abdomen to accommodate the enlarging lower body during progress of the pregnancy. As axis of significantly lower elasticity (designated by arrows 40 in FIGS. 1, 2 and 4) is oriented perpendicularly to the highly elastic axis to provide strong upward and inward support for the abdomen, uterus, and buttocks.

It is preferred that the ratio of elasticities or stretch lengths of the two axes be about four to one or more. A satisfactory fabric having these properties is available from Darlington as Style No. 4109 in a weight of about 6.5 ounces per square yard. This material is 13% "Lycra" spandex of about 140 denier, and 87% nylon (40 denier and 15 denier combined). The highly elastic axis of this fabric has a stretch length of about 185% (i.e., 285% of the unstressed dimension), whereas the low-elasticity axis has a stretch length of only about 40% (140 percent of the unstressed dimension).

Crotch panel 25, yoke panel 33, and straps 36 and 37 are formed from a fabric of low elasticity along the longitudinal axes (the long dimensions of the yoke and crotch panels) of these panels, but somewhat greater elasticity can be tolerated along the width axes. A satisfactory material is a polycotton (polyester-cotton) blend available from Milliken as Style No. 6995-10, with a weight of 5.7 ounces per square yard. The longitudinal stretch of this fabric is 10%, and lateral stretch is 30%. The material is 82% polyester (100-denier 34-filament yarn) and 18% cotton. This material is comfortable against the body, and has excellent moisture absorption and evaporation properties.

From a functional standpont, the crotch panel provides a relatively inelastic lower anchor for the garment, and provides a desirable upward pressure on the crotch area to alleviate the discomfort of vulvar varicosities. The remainder of the pantie has high lateral or sideways elasticity to expand as the pregnancy progresses, but much less stretch or "give" in a vertically upward direction, thereby providing the desired powerful support for the abdomen and buttocks. Upward tensioning of the pantie front panel (where the major expansion occurs during the course of pregnancy) is provided by the largely inelastic shoulder straps which are secured to the similarly inelastic yoke panel.

While the shoulders form an upper anchor for the garment, the yoke panel plays an important role in distributing the reaction force from the stressed pantie panels across the physically strong middle and upper back. Significantly, these loads are applied in a manner which urges the back into a posturally correct erect position which minimizes the risk of back strain and discomfort which are common complaints during pregnancy.

An important element in focusing the garment forces to assist in maintaining proper back posture and load distribution is the upward and rearward inclination of the upper edges of midback panels 14 and 15. This configuration spreads the transmitted forces along the lower length of the yoke panel, and assists in focusing the load on the mid-scapular region of the back to press the back into an erect and proper position. The net result is a powerful support urging the abdomen and uterus upwardly and inwardly, combined with good support for the buttocks and a broad range of lateral expansion which enables the garment to be worn throughout pregnancy.

In an advanced pregnancy stage as suggested in FIG. 4, the undergarment in effect functions as an abdominal sling with the lower part of the pantie front panel having further securement or anchorage beneath the protruding abdomen. Preferably, the front panel is dimensioned to reach approximately full lateral elongation during the final stage of pregnancy to provide the maximum body support needed during the phase of full abdominal expansion.

Figure 6:
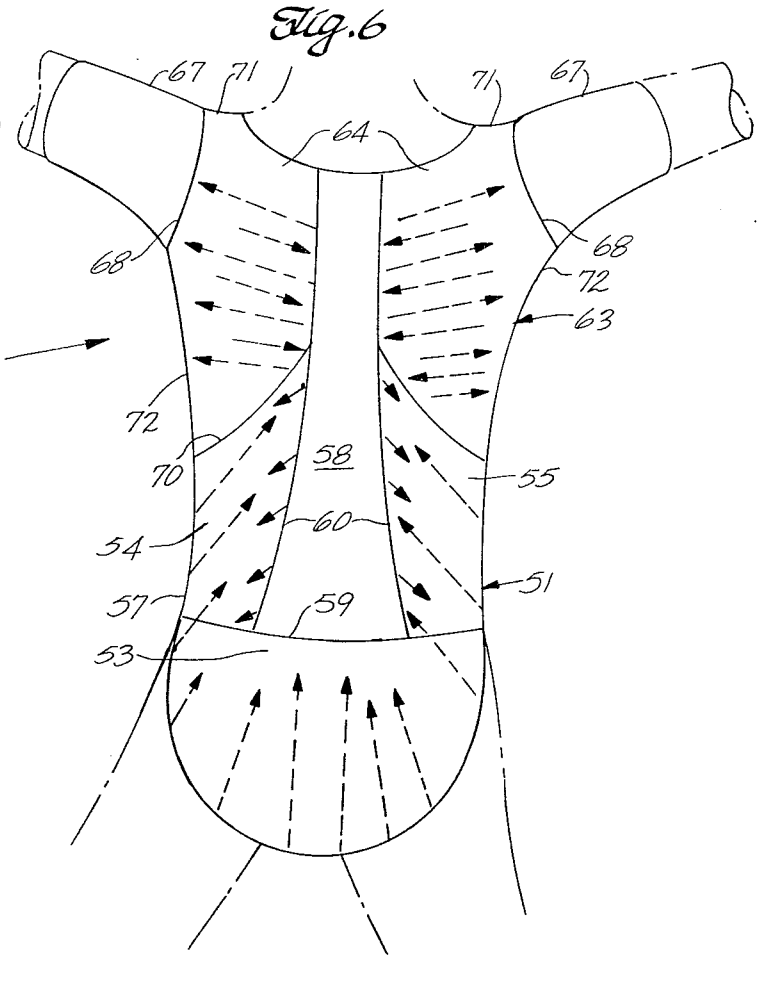
FIG. 6 is a rear view of the leotard.
Figure 5:
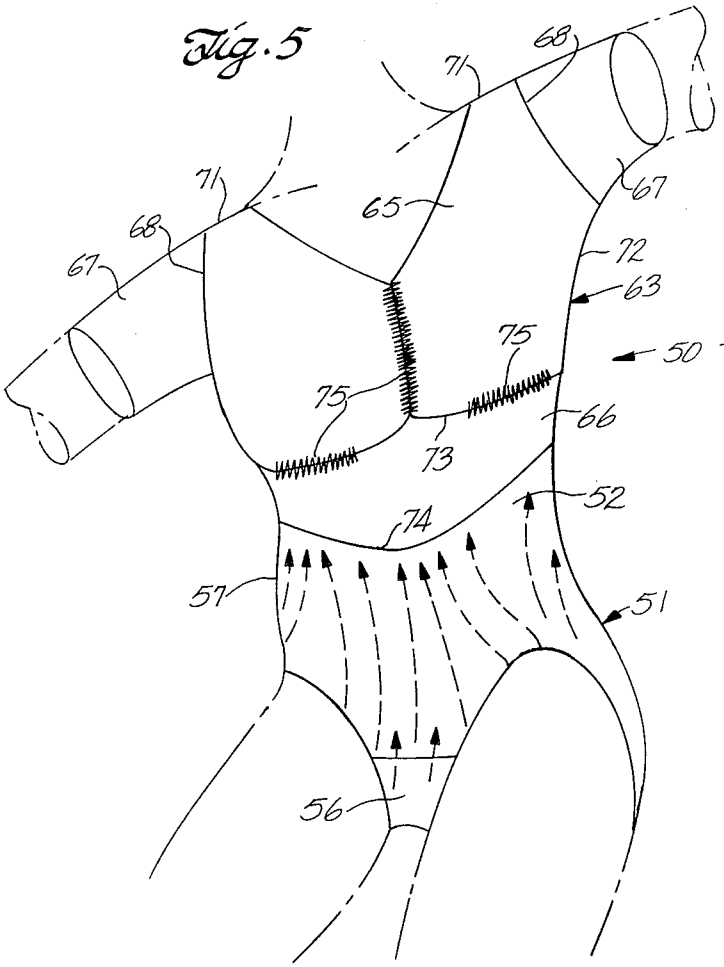
FIG. 5 is a front view of a leotard according to the invention.
Figure 7:
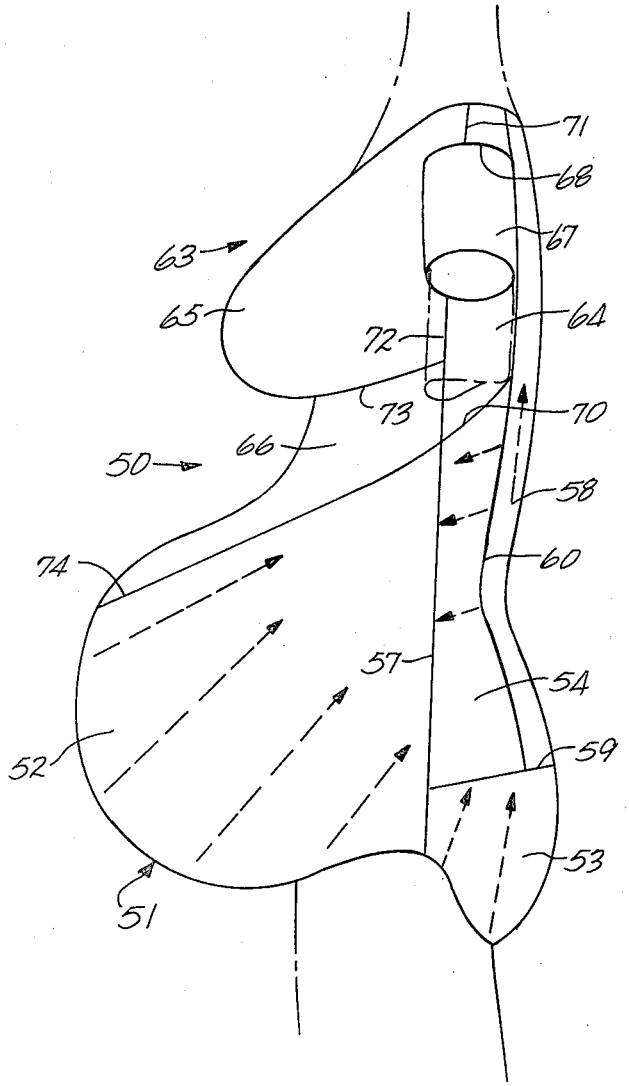
FIG. 7 is a side view of the leotard as enlarged during a late stage of pregnancy.

The principles of this invention are equally applicable to maternity outerwear, and FIGS. 5–7 show a leotard 50 designed for wear during exercise classes and similar physical activities where body support is important. The lower part of the leotard generally corresponds to the construction of undergarment 10, but attachment-means straps 36 and 37 are replaced by additional garment portions covering the upper body and securing to tension the lower portion, and to transfer the resulting forces to the shoulders and back.

Leotard 50 has a pantie 51 with a front panel 52, seat panel 53, a pair of midback panels 54 and 55, and a crotch panel 56. As with the undergarment, the front, seat, and midback panels are joined at side seams 57, and the crotch panel is stitched to the lower ends of the front and seat panels. A yoke panel 58 has a lower end secured by stitching 59 (which also connects the midback and seat panels) to the seat panel, and side edges secured by stitching 60 to the spaced-apart lateral edges of the midback panels. These panels are preferably shaped as and made from the same materials described above with reference to the undergarment.

The leotard is completed by an upper body portion 63 which is conveniently formed of a pair of upper-back panels 64, a pair of breast-supporting upper-chest panels 65, and a lower-chest panel 66. The addition of either short or long enclosures for the arms is optional, and the leotard is shown with a pair of short sleeves 67 secured to the upper body portion by stitching 68.

The upwardly and rearwardly contoured edges of midback panels 54 and 55 are joined to upper-back panels 64 by stitching 70, and the rear side edges of the upper-back panels are secured to the yoke panel by a continuation of stitching 60. The upper-back and upper-chest panels are joined at their upper ends by shoulder-line stitching 71, and at their side edges by underarm vertical stitching 72.

The upper- and lower-chest panels are joined by stitching 73 beneath the bustline. The ends of the lower-chest panel are joined to the forward ends of upper-back panels 64 by a continuation of side stitching or seams 57 and 72. Finally, the lower edge of the lower-chest panel is fastened to the upper edge of the pantie front panel by stitching 74. Preferably, shirring 75 is formed along stitching 73 and between the breasts to define the bustline of the garment, and to supplement the support of a maternity brassiere usually worn with the leotard.

Upper body portion is preferably made from a poly-cotton Lycra spandex blend as available from Summit Knitting Mills under Style Nos. 1019 or 1020. This fabric has a weight of 5.7 ounces per square yard, and is a blend of 46% polyester, 46% cotton, and 8% Lycra spandex. This fabric has a stretch elongation of about 100% along both the length and width axes. This fabric absorbs perspiration, is comfortable against the skin, and has good body-conforming qualities which enhance the appearance of the leotard when worn.

The support function of leotard 50 is substantially the same as that of undergarment 10, with the upwardly directed tensioning force on the pantie being applied by the upper body portion. The upper body portion in turn transfers these loads to the shoulders and back in a fashion which urges the back into a posturally correct position and spreads the loads over the structurally strong shoulders and back.

The wide and longitudinally inelastic yoke panel used in these garments provides an anchorage for the elastic supporting panels, and is one of the significant features distinguishing the garments from known maternity support clothing. The relatively large width (as compared to a simple vertical back seam) of the yoke panel assumes good distribution of the support loads, and enables the focusing action of the midback panels to apply these loads to aid in improved posture. The strong upward and rearward utero-abdominal support also corrects the center of gravity of the pregnant wearer to a more stable and comfortable position. If desired, the garments can be worn after pregnancy by darting the highly elastic support panels to conform to the reduced figure.

There has been described a new and effective design for maternity garments which are attractive and comfortable to wear, and which take full advantage of the unequal biaxial stretch properties of modern elastic fabrics to accommodate an enlarging figure without loss of strong upward support. The use of these fabrics, coupled with the yoke panel described above, provide a significant improvement in function, fit, and comfort for the pregnant woman.

What is claimed is:

1. A maternity garment, comprising:

a yoke panel configured to extend from an upper edge adjacent the lower neck of a wearer to a lower edge adjacent the waistline, the yoke panel being of sufficient width to cover and extend sideways from the backbone to generally vertical lateral edges, and being formed from a first material which is substantially inelastic when stressed in the vertical direction generally parallel to the backbone;

a support pantie covering the lower trunk of the wearer, and having a seat portion with an upper edge secured to the lower edge of the yoke panel, a front portion enclosing the abdomen and having an upper edge at about the waistline, a pair of midback portions positioned on opposite sides of and secured to the side edges of the yoke panel and to the top of the seat portion, the seat and midback portions extending forwardly around the body to join the front portion, and a crotch panel secured to lower ends of the front and seat portions to define a pair of leg openings, the front, seat, and midback portions being made of a second material which is highly elastic and expandable in a generally horizontal axis normal to the backbone, and substantially less elastic and therefore supportive in a generally vertical axis parallel to the backbone; and attachment means configured to fit over the wearer's shoulders and connecting an upper part of the front portion and the upper part of the yoke panel to apply an upwardly directed tensioning force to the support pantie to support and urge the abdomen upwardly and rearwardly.

2. The garment as defined in claim 1 wherein the pantie midback portions have upper edges which are upwardly and rearwardly inclined, the upper edges having axes with a theoretical intersection at about the mid-scapular region of the back.

3. The garment defined in claim 1 wherein the first material has a stretch length about 10% in said vertical direction, and the second material has a ratio of stretch lengths in the horizontal and vertical axes respectively of at least four to one.

4. The garment defined in claim 3 wherein the second material has a stretch length of about 185% horizontally, and about 40% vertically.

5. The garment defined in claim 3 wherein the crotch panel is made of said first material.

6. The garment defined in claim 3 wherein the front panel is dimensioned to be about fully expanded in the horizontal direction for the maximum size of body figure to be accommodated.

7. The garment defined in claim 1 wherein the attachment means comprises a pair of straps configured to pass over the wearer's shoulders and connected to the upper edge of the pantie front portion and the upper edge of the yoke panel.

8. The garment defined in claim 7 wherein the straps are integral extensions of the yoke panel.

9. The garment defined in claim 8 wherein the securement of the crotch panel to the front portion is provided by a hook-and-pile fastener, and further comprising a flap having an edge stitched to the front portion, the flap extending over the fastener.

10. The garment defined in claim 1 wherein the attachment means comprises an upper body portion extending over the chest, shoulders, and back, and secured to the pantie front panel and the yoke panel.

11. The garment defined in claim 10 wherein the body portion is made of a polycotton-spandex fabric having a biaxial stretch length of about 100%.

12. The garment defined in claims 8 or 10 wherein the pantie midback portions have upper edges which are upwardly and rearwardly inclined, the upper edges having axes with a theoretical intersection at about the midscapular region of the back.

13. The garment defined in claim 12 wherein the first material has a stretch length of about 10% in said vertical direction and a substantially greater stretch length in an axis normal to said vertical direction, and the second material has a ratio of stretch lengths in the horizontal and vertical axes respectively of at least four to one, the second-material horizontal stretch length being about 185%.

* * * * *